US008863909B2

(12) United States Patent
Dudde et al.

(10) Patent No.: US 8,863,909 B2
(45) Date of Patent: Oct. 21, 2014

(54) BRAKING DEVICE FOR BRAKING A LIFT CAR

(75) Inventors: Frank Dudde, Collierville, TN (US); Philllip Federle, Blaubeuren (DE)

(73) Assignee: Thyssenkrupp Elevator AG, Dusseldorf (DE)

( * ) Notice: Subject to any disclaimer, the term of this patent is extended or adjusted under 35 U.S.C. 154(b) by 318 days.

(21) Appl. No.: 12/762,928

(22) Filed: Apr. 19, 2010

(65) Prior Publication Data

US 2011/0100761 A1 May 5, 2011

Related U.S. Application Data

(63) Continuation of application No. PCT/EP2008/008647, filed on Oct. 13, 2008.

(30) Foreign Application Priority Data

Nov. 12, 2007 (EP) ..... 07021915

(51) Int. Cl.

| | |
|---|---|
| ***B66B 5/18*** | (2006.01) |
| *B66B 5/04* | (2006.01) |
| *B66B 5/12* | (2006.01) |
| *B66B 5/14* | (2006.01) |

(52) U.S. Cl.

CPC ..... *B66B 5/18* (2013.01)
USPC ..... 187/359; 187/371; 187/376; 187/350; 188/188; 188/189

(58) Field of Classification Search

CPC ..... B66B 5/18
USPC ..... 187/350, 371, 376, 305, 359, 373; 188/65.1, 188, 189, 216
IPC ..... B66B 5/16,5/18
See application file for complete search history.

(56) References Cited

U.S. PATENT DOCUMENTS

| | | | | |
|---|---|---|---|---|
| 3,706,361 | A | 12/1972 | Paulssen et al. | |
| 5,234,079 | A | 8/1993 | Nomura | |
| 5,819,879 | A | 10/1998 | Lang et al. | |
| 2004/0262091 | A1 * | 12/2004 | Ito | 187/372 |
| 2005/0126862 | A1 * | 6/2005 | Ito | 187/350 |
| 2006/0090969 | A1 * | 5/2006 | Eckenstein et al. | 188/65.1 |

FOREIGN PATENT DOCUMENTS

| | | |
|---|---|---|
| CH | 684 190 | 7/1994 |
| CH | 684 190 A5 | 7/1994 |
| DE | 1 203 933 | 4/1962 |

(Continued)

*Primary Examiner* — William A Rivera
*Assistant Examiner* — Stefan Kruer
(74) *Attorney, Agent, or Firm* — Shlesinger, Arkwright & Garvey LLP

(57) ABSTRACT

A braking device (2) for braking a lift car which moves relative to a lift shaft, having at least one braking module (6) which is provided in order to interact with a device, and having a catch (4) which can be adjusted between two operating positions (36, 360, 38), wherein the catch (4), in a first operating position (36, 360), is connected to the at least one braking module (6) such that the catch (4) transmits a release force (22) to the at least one braking module (6), and wherein the catch (4), in a second operating position (38), is separated from the at least one braking module (6), and the at least one braking module (6) is therefore in contact with the device.

14 Claims, 13 Drawing Sheets

(56) References Cited

FOREIGN PATENT DOCUMENTS

| | | | |
|---|---|---|---|
| DE | 39 34 492 | | 4/1990 |
| DE | 197 19 079 | C1 | 9/1998 |
| DE | 100 49 168 | A1 | 5/2001 |
| DE | 100 15 263 | A1 | 10/2001 |
| EP | 0 841 282 | | 5/1998 |
| EP | 1 283 189 | A1 | 8/2001 |
| EP | 1 719 730 | A1 | 5/2005 |
| JP | HO4-173683 | | 6/1992 |
| WO | WO 94/02404 | | 2/1994 |
| WO | WO 00/39016 | | 7/2000 |
| WO | WO 2004/110916 | | 12/2004 |
| WO | WO 2005/068342 | | 7/2005 |
| WO | WO 2005/068342 | A1 | 7/2005 |

* cited by examiner

BRAKING DEVICE FOR BRAKING A LIFT CAR

RELATED APPLICATIONS

This is a continuation of International PCT Application No. PCT/EP2008/008647, filed Oct. 13, 2008, claiming the priority benefit of EPC 07 021 915.9, filed Nov. 12, 2007, hereby incorporated by reference.

FIELD OF THE INVENTION

The invention relates to a braking device for braking a lift car, a lift facility, and a method for adjusting at least one braking module.

BACKGROUND OF THE INVENTION

For braking and catching a lift car of a lift facility, different mechanisms are known which can be realized by suitable braking devices.

For providing strong compression forces, for example, for a brake and for being able to release these forces in the so-called fail-safe mode and thus in a fail-safe or failure-resistant operation, commonly electromagnets are used as described in the document DE 100 49 168 A1, for example. However, those have the disadvantage that large release gaps can not be realized between friction pads which here are actuated by a coil arrangement and that the weight of the brake is relatively high.

Spring systems can be used in order to realize larger release gaps. One example of those are spring brake actuators having coil springs such as those used in cranes or other industrial facilities in the case of the document DE 197 19 079 C1. However, such brakes are relatively heavy and require a noisy pneumatic or hydraulic release mechanism which is susceptible to leakage and/or contamination so that they do not allow the use of safe drives for releasing these brakes.

A braking device known from the document DE 202 16 046 U1 includes a disc brake which can equally be used as a linear brake, however, wherein the braking force is directly applied by lever arms. In this braking device, it is provided that the complete release system does not include any self-locking components in order to satisfy the requirement of a safety brake. For providing large release gaps, such spring arrangements require a high release force, though, and furthermore the actuation time in the case of a failure of the power supply is long.

A braking device with which a large release gap can be realized is described in the document DE 100 15 263 A1. In this device, linear movements of a drive unit are used so that brake pads of this braking device can travel relatively large distances. Here, a linear unit is used simultaneously to generate a compression force for the brake pads. However, this braking device has no fail-safe function.

If in the present state of the art a fail-safe brake having the corresponding release gap is to be realized, it would have to actuate very rapidly in order to be able to carry out emergency-brake functions. However, this causes a very high noise level. A slow and thus quiet application in the normal operating condition, i.e. when no dangerous situation exists, is not possible in this case.

So-called catching devices with which an instantaneous stopping can be caused are realized in the current state of the art by so-called wedge brakes. Herein, as described in the document EP 1 719 730 A1, for example, a braking wedge is applied to the rail of a lift facility via a countersurface. By the friction generated at the rail, a countersurface of the braking wedge is further drawn in and thus generates the necessary compression force for braking the lift car. Energy stored by springs or weights is in this case only used for safely applying the braking wedge so that it generates the braking force due to the geometry and the kinematics of the entire system. Such catching devices usually generate the required braking energy by generating friction forces at the rail by the braking wedge or its countersurface. Another method for reducing the kinetic energy of the lift car is based on the fact that the braking wedge or the countersurface carries out deformation work at a rail of the lift facility. Hereby, large amounts of energy can be reduced relatively easily.

An alternative to this catching device is described in the document EP 1 283 189 A1. Here, a pull-in lever assuming the function of the braking wedge in conventional braking is used for the generation of the compression force. This pull-in lever has the function of being clamped and pulled in by its geometry and arrangement and thereby to generate a high compression force when a lift car is caught.

SUMMARY OF THE INVENTION

The invention relates to a braking device for braking a lift car which moves relative to a lift shaft having at least one braking module which is provided in order to cooperate with a device, and having a catch which can be adjusted between two operating positions, wherein the catch, in a first operating position, is connected to the at least one braking module so that the catch transmits a release force to the at least one braking module, and wherein the catch, in a second operating position, is separated from the at least one braking module so that the at least one braking module is in contact with the device.

This braking device is also designed to realize an emergency brake as one form of a braking operation in the second operating position of the catch so that the braking device can also be called a "catching device". In the first operating position, it is provided that the width of a release gap between the at least one braking module and the device can be adjusted by regulating the release force so that the braking force can be adjusted in an appropriate manner. Thus, it is also possible to permit an unbraked travel of the lift car in the first operating position.

In one embodiment, the device is configured as a stationary device, e.g. as a rail of a lift facility. A movement of the lift car can be braked and cushioned with the braking device.

In another embodiment, the braking device is fixedly arranged relative to the lift shaft. In this case, the braking module is designed to cooperate with a moving device. In this context, the moving device is configured as a support means, e.g. as a rope or a set of ropes. By such a transport means the lift car is moved within the lift shaft. By the cooperation of the braking module with the drive means a movement of the drive means and thus of the lift car can be braked in the first operating position as required. In the second operating position, the movement of the drive means and thus of the lift car is emergency-braked and cushioned, respectively.

The braking device includes at least one drive for the provision and variation of the release force.

Moreover, the braking device can have a holding device configured as an electromagnet, for example, which is designed to hold the catch in the first operating position. In the first operating position, the electromagnet holds the catch in a powered state. The electromagnet can be supplied with electric energy and thus with a current provided by the lift facility, for example, in such a way that the catch is released from the electromagnet in case of a power outage so that an emergency stop of the lift car can be effected.

Furthermore, the braking device can have at least one lever which is designed to adjust a distance between the braking module and the device.

In one variant, it can be provided that the braking device has one force module and/or an energy storage configured as a spring, for example, which is designed to provide a braking force for the at least one braking module. Herein, the braking force is vectorially counteracting the release force.

The at least one braking module can have a counterpart as a component which is designed to cooperate with the catch, wherein the catch engages the counterpart in the first operating position.

In another embodiment, the braking device can have at least one catching aid designed to transfer the catch, e.g. autonomously and/or electromechanically, from the second operating position to the first operating position.

The lift facility according to the invention has at least one braking device as described above and at least one lift car.

Furthermore, the invention relates to a method for adjusting at least one braking module for a lift car which moves relative to a lift shaft, wherein the at least one braking module is provided to cooperate with a device. In this method, a catch is switched back and forth between two operating positions, wherein the catch, in a first operating position, is connected to the at least one braking module so that the catch transmits a release force to the at least one braking module, and wherein, when switching to the second operating position, the at least one braking module and the catch are separated from each other so that the at least one braking module gets into contact with the device.

With the method, in the case that the catch is in the first operating position, it is possible to regulate a width of a release gap between the device and the at least one braking module by changing the release force so that the lift car is braked. A change of the release force causes an application of the brake pads to the device. By further reducing the braking force, a defined braking force can be provided in this case.

In the case that the catch is in the second operating position, it is possible that the at least one braking module gets into contact with the device so that the lift car is stopped or emergency-braked.

At least one step of the method according to the invention can be carried out by the braking device according to the invention or by at least one component of this braking device. A function of at least one component of the braking device or of the braking device itself can be realized as a step of the disclosed method.

Typically, the braking device comprises at least one braking module which can cooperate with at least one device and usually with at least one catch.

With this braking device, e.g. a safety brake can be realized, wherein the actuation of the brake can be triggered by a catch mechanism which can include the catch.

In one variant of the braking device, it is provided that the catch is moved by a drive module or a drive as a component of a catch mechanism by which the at least one braking module can be closed and opened, wherein such drive can also be configured as a release drive of the braking device.

A release force of the braking device which is among other things provided by a cooperation of the catch and the electromagnet such that the braking module is distanced from the device under provision of the release gap can be interrupted by the catch. Thus, the catch is configured as a transfer means for providing an interaction between the drive module and the braking module.

The at least one catch mechanism can also have an energy storage, for example, which is suitable for applying a force by which the catch can be locked-in at the braking module so that the catch is in the first operating position again after this locking-in, starting from the second operating position, and so that the release gap is provided between the braking module and the device.

In a release unit as another optional component of the catch mechanism of the braking device, another transmission can be disposed. Furthermore, the catch mechanism can have an autonomous and/or automatic catching aid or catching unit.

In the operation of the braking device, it is provided that the catch falls down and thus separates from the braking module when the electromagnet is switched off, i.e. when the power supply of the electromagnet is interrupted. As long as the electromagnet is powered, the catch is held in the first operating position. In the moment when the electromagnet is no longer powered, the electromagnet can no longer magnetically attract the catch so that the catch is released from the electromagnet and thus simultaneously separated from the braking module.

The catch mechanism for a suitable positioning of the catch in a respective operating position which is among other things provided in the framework of the invention can be designed so that braking operations which are to be carried out in a conventional way by the braking device are not influenced.

Furthermore, the braking device can include a self-locking drive and/or a self-locking transmission as possible components of the catch mechanism.

The catch mechanism typically has no self-locking elements for braking. In the first operating position, the catch can be supplemented with a self-locking transmission and a drive, among other things.

A releasing of the braking device and in particular of the braking module of the braking device which usually always occurs when the catch is in the first operating position can in an embodiment also be provided as a so-called symmetric release which is also possible in case of a motor-powered release operation. The described symmetric release can be realized by driving at least one lever as a component of the catch mechanism, wherein such a lever is applied in at least one fixed point. By a suitable positioning of the at least one fixed point and a suitable dimensioning of the at least one lever, a transmission of the release force provided for the release is possible. Herein, a release path can be realized by an eccentricity of the at least one lever. The described catch mechanism or a corresponding apparatus for the release can furthermore be used for releasing other braking modules.

The braking device can be designed so that a transition of the catch from the first operating position to the second operating position is carried out in a short period and thus jerkily. If a suitably dimensioned energy storage, in particular a spring, designed for acting upon the braking module is used, the release gap between the braking module and the device can immediately be closed by a sufficiently large compression force so that with the braking device, among other things, an emergency-braking operation can be carried out so that the braking device can also be called a catching device in this respect. Such a catching device is also triggered and thus activated by a change of the operating position of the catch and a resulting change of a position or orientation of the braking module relative to the device.

An emergency-braking operation and thus a catching operation of the moving lift car relative to the lift shaft can be carried out in various driving directions. Thus, in the case that the device which is stationary, in particular, is designed as a rail of a lift facility, it is possible that both an upward and a downward movement of the lift car is rapidly and safely stopped by the braking device.

If the device is designed as a moving device such as a support means, a downward movement of the lift car can efficiently be braked or stopped if the braking module in particular cooperates with a downwardly moving rope of the support means. An upward movement of the lift car is efficiently braked or stopped by the cooperation of the braking module in particular with an upwardly moving rope of the support means. Usually, a braking or stopping of a movement of the lift car can be carried out independently of the direction by the cooperation of an arbitrary portion or rope of the support means by the braking module.

In another variant, the braking device, in particular if it is designed for catching the lift car, can have a braking module designed as a catching wedge, wherein such a catching wedge cooperates with an actuating unit which is triggered by the catch in the transition to the second operating position, in turn, so that the catching wedge can cause an emergency-braking operation. The generation of the braking force can occur through a wedging operation of the catching wedge.

By the invention, among other things, a braking device having a large release gap for braking and/or catching a lift car can be realized. Because of the compression spring for acting upon the braking module and because of the use of the electromagnet for holding the catch, this braking device autonomously draws in completely in the case of a power supply outage. Thus, it is fail-safe in any operating situation.

By a lever driver as a component of the catch mechanism, a transmission between a release motor as a drive of the catch mechanism and the release force acting upon the braking module engaging the spring can be adjusted. Among other things, the lever driver enables a symmetric release. Thereby, the lift car, a lift cabin or a corresponding vehicle can start moving without grinding sounds of brake pads of the at least one braking module, without the braking device for braking being completely released, because the brake pads simultaneously lift off from the device and are thus separated from the device.

By the catch mechanism or at least a component of the catch mechanism, e.g. the drive or the release motor, the braking device for braking can be motorically opened and closed. In this context, it is usually provided that the release force generated by a suitable movement of the drive is transferred from the drive via the catch as a means for transferring the release force to the braking module.

By the possibility of motorically applying braking modules which can have brake shoes or brake pads to the device such as a rail, the impact velocity of the brake pads at the rail can be controlled. Thereby, the actuation velocity and the noise level in the actuation of the catch and thus the braking module can further be regulated.

By a correspondingly designed drive of the catch mechanism and a release device, respectively, also the compression force applied via a fail-safe function can be controlled and thus regulated. A motoric application of the release device can also occur shortly before initiating a braking operation, whereby the actuation time of the brake and a braking module, respectively, can be shortened. This can be carried out motorically or by a catch.

By the electromagnet as an emergency-device for actuating the catch, even not safe drives can be used for releasing the brake.

Compared to not self-locking systems such as a screw drive, the actuation time by the catch mechanism is much shorter. That implies that a free fall of the lift car in the case of a power outage can not occur or can only occur for a very short time. In the case of a brake without an autonomous return mechanism for the catch, the described braking device satisfies the basic requirements of catching devices for lifts according to EN 81. Because of an actuation by the electromagnet, very short actuation times are possible. The actuation of the braking device can additionally be regulated with several velocity levels by a motor acting upon the catch.

Areas of application of the braking device in the field of lift construction are so-called rail brakes. In this case, the lift car usually has a considerable clearance with respect to its guide rails. The guideline for lifts and EN 81 require so-called fail-safe braking systems, i.e. operationally safe braking systems, however, in order to avoid a fall of the lift car or the lift cabin with a very high degree of safety. Thus, a braking system has to be used which combines large release gaps and the fail-safe aspect.

The braking device can be realized as a rail brake, for example. In this case, the braking force is not generated in the engine room but in the lift car, i.e. exactly where it is required.

Because of the catch mechanism, the braking device can also be used as a catching device in lifts. Furthermore, a combination of a braking device and a catching device in the braking device is possible. This implies that, e.g. when both systems, i.e. the braking device and the catching device, are actuated, no extremely high decelerations will act upon passengers in the lift car.

Thus, with the braking device, among other things, a lift-catching device having trigger units subject to centripetal forces can be realized in order to detect a too high velocity of the lift car. These trigger units can lock in with their centripetal weights and thereby actuate the catching device by moving the catch from the first to the second operating position.

Another possible application of the brake is possible in the field of construction machines, of mining and in the entire field of rail-bound transport facilities. Because of the large release gap, the brake can be used in strongly polluted environments. The fail-safe system provided in the framework of the invention enhances the reliability and safety of the described arrangement also in this area.

Thus, the invention, among other things, relates to a braking device for braking, e.g. for decelerating and/or stopping motions of lift cars. The braking of rail-bound transport facilities, in particular of lifts, is in this case carried out by friction at a stationary rail oriented in parallel to the transport facility as a stationary device. As an alternative to the rail, the same application can also be used for braking rotational movements at a brake disc as a device. The friction linings of the braking module are moved approximately in a perpendicular direction to the rail from a release position and thus from the first operating position to a braking position and thus to the second operating position. In this way, a braking operation is initiated. A variant of the braking device includes a brake pad as a braking module.

In another embodiment, the braking force is generated or amplified by a wedge. This wedge can be moved over its countersurface and thus be applied under an angle less than 90° with respect to the rail and thus not perpendicularly to the direction of the rail.

By one or more energy storages such as compression springs, the compression force of the braking module necessary for generating friction against the device is generated. This guarantees that the full braking force is provided in the case of a power-supply outage.

The movement from the braking position to the release position is carried out with an energy-uptake of the braking device or a corresponding total system. Herein, a flux of the tensile force is deflected in the region of at least one braking module designed as a brake shoe, for example. The bridging of the tensile force is carried out by means of the lever driver.

An embodiment of the braking device provides an arrangement of a lever which has no fixed point. In this case, the release path and thus the release gap is generated by an eccentricity of the lever. A point of application of the force can thus be outside a plane of the device and thus of the rail, for example. In the case of using two levers, for example, this obviates the provision of an intermediate part.

By a varying arrangement of a fulcrum at the lever, a transmission ratio of generated and required release force can be provided. The force for releasing the braking module can be generated by an electromotor, hydraulically, pneumatically or by other energy converters. A transmission by a gear unit is possible. A drive can also be used for releasing several braking modules for braking and/or catching. Self-locking components can be used in this context for saving supply energy without influencing the safety function of the braking device and thus of the braking module. At the end of this drive and transmission unit, typically a linear movement transferred to the catch is generated.

For causing an actuation of the braking device, there are two possibilities of terminating the released state. This can be carried out by reducing the release force and thus displacing the catch or by interrupting the force transfer, e.g. by locking out or folding down the catch.

Each of these two conditions and of these two operating positions, respectively, can safely be detected by corresponding information providers and be processed by a controller as another component of the braking device. This can be realized by switches in the stop positions, by measuring elements or by stepper motors.

In systems that are not self-locking, the decline of the release force can be realized by interrupting the generation of the release force. A first variant is to reverse the actuation direction of the release force generated by the drive which is also possible in self-locking systems. The second variant is based on an interruption of the flux of the force through the catch by folding the same down. Hereby, the electromagnet holding the catch in its position is switched powerless.

By the gravity of the catch, a correspondingly configured shape-matching between the catch and the counterpart of the braking module or by energy from previously tensioned elements such as springs or other energy storages or energy converters, the catch is brought out of its position. A combination of these possibilities is also feasible.

The braking device for braking and/or catching a lift car is in one configuration designed for a maximum total cabin weight of 1330 kg in a ropeless lift facility. In this case, the braking device and the braking system, respectively, is displaced from the engine room directly to the lift car or the cabin. For example, the following basic conditions can be satisfied:

- braking of at most 1330 kg
- deceleration in the case of a completely loaded lift car and a failure of a braking device at an acceleration of a=−0.3 g
- maximum deceleration for the passenger: 1 g
- release gap of the brake 4 mm
- lifetime 9000000LW (load changes)

Furthermore, two braking modules can be used so that a safety-rail brake having a rail depth of approximately 50 mm and a rail thickness of approximately 16 mm can be realized.

By the release mechanism of the braking device, two braking modules can be released symmetrically. That means that both brake shoes simultaneously move away from the rail. Thereby, the lift car even with a not yet completely released brake can start moving without grinding noises. Thereby, even a reduction of the release gap shortly before reaching a hold location is possible. By this means, velocity losses by the transmission of the levers can be compensated. Thereby, even the use of lighter and slower motors as drives for catch mechanisms is possible.

If slower application velocities can be realized, also the noise level in the actuation of the brake is considerably reduced which means an increase of comfort for the passengers.

With the braking device for braking several actuation velocities can be realized because of the structure having a motoric operation and a catch-actuation. By the use of the electromagnet, the braking device for braking is suitable as a catching device for conventional rope-lifts for too high upward velocities as well as too high downward velocities.

The electromagnet can be configured as a safety magnet to be powered by 12V. The braking device can be used as a braking device, a holding device and a catching device. Thereby, maximum decelerations acting upon the passenger in case of a simultaneous actuation of all braking modules can be considerably reduced. Furthermore, the braking device can be used for an unsafe drive, wherein an actuation velocity can be controlled and a symmetric release behavior can be regulated. A fixation of the motor as a drive of the catch mechanism is to be constructed according to the mounting situation. A bolt at the rear end of the drive configured as a motor, for example, can be fixedly mounted. A bolt connecting the catch and the motor can be linearly guided in order to be able to receive the force of the motor.

The described invention can among other things be used as a catching device and/or a safety brake. With the catch, a transmission of a tensile force and/or a compression force is possible. In the framework of the invention, the braking force can be adjusted by the release force. Moreover, a use of the braking device as a rope brake is possible, in which case it is provided that the braking module is fixedly mounted and in contact with a moving rope as a device in order to cause a braking operation. In another configuration, the braking device can also be used for braking rotational movements of rotating devices.

Other advantages and configurations of the invention will be understood with respect to the specification and the accompanying drawings.

It will be understood that the characteristics mentioned above and the characteristics to be explained below can be used not only in the respective indicated combination but also in other combinations or individually, without leaving the scope of the present invention.

BRIEF DESCRIPTION OF THE DRAWINGS

The invention is schematically illustrated with respect to embodiments in the drawings and will be described in detail referring to the drawings below.

DETAILED DESCRIPTION OF THE INVENTION

Figure 1:
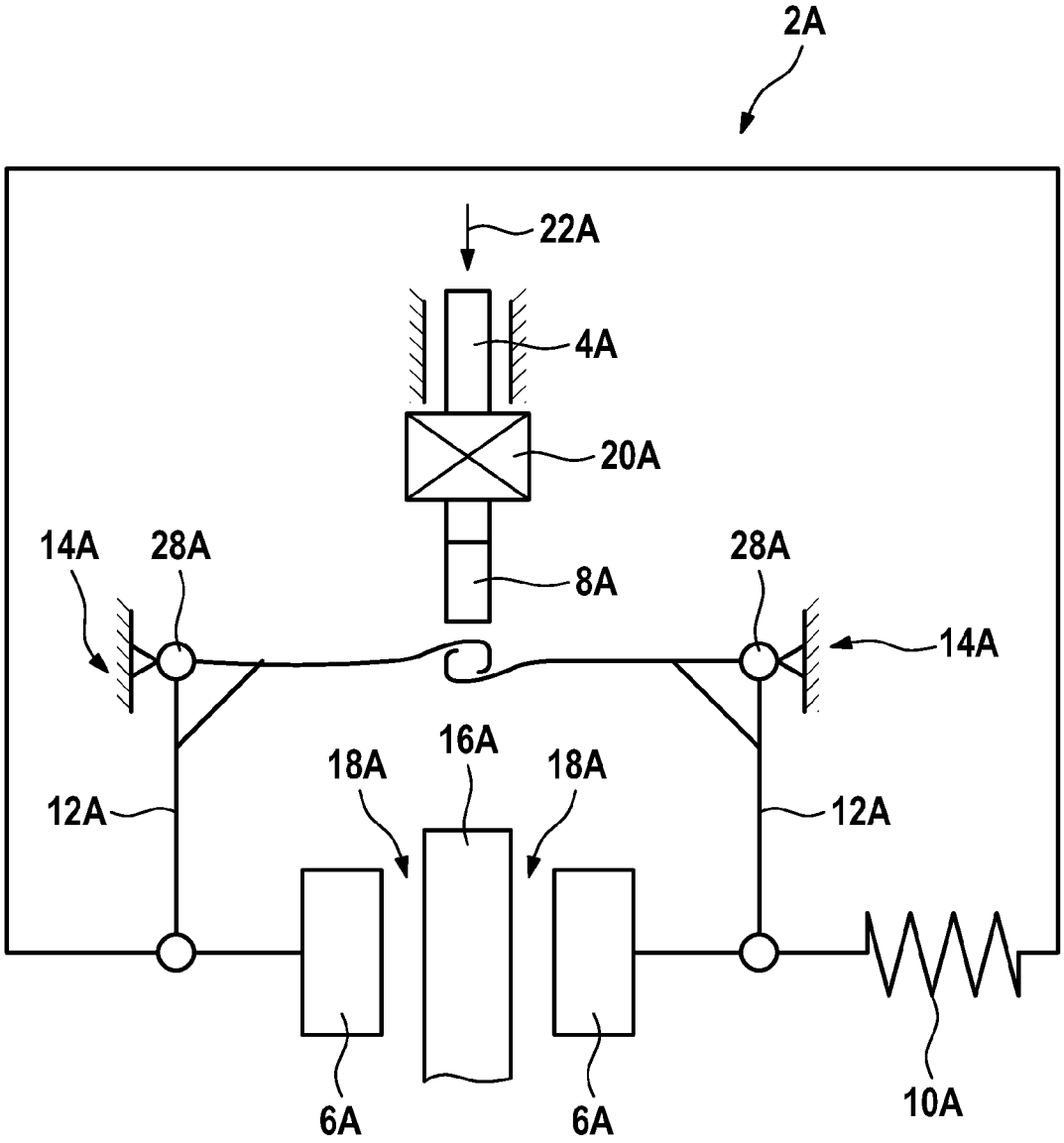
FIG. 1 shows a schematic view of a first embodiment of a braking device according to the invention.

The first embodiment of a braking device 2A for braking a lift car which is schematically illustrated from above in FIG. 1 includes a catch 4A and two braking modules 6A configured as brake shoes which are connected to a common counterpart 8A, wherein this counterpart 8A is in contact with the catch 4A in the operating position shown in FIG. 1. It is provided that the lift car can carry out a movement along a rail 16A as a device. In the context of the present invention, the term "lift car" denotes any kind of "vehicle" for the transport of loads or persons moving relative to a lift shaft.

In this first operating situation, both braking modules 6A are distanced from the rail 16A with formation of two symmetric release gaps 18A by a spring 10A and two levers 12A which are each supported by fulcrums 28A at a wall structure 14A.

In this first operating position, it is further provided that an electromagnet 20A pulls the catch 4A upwards (i.e. against gravity). This measure allows to connect the braking module 6A by the counterpart 8A to the catch 4A. A release force 22A indicated by an arrow which is required for this purpose is provided by a drive of a catch mechanism not shown here which causes a reciprocating movement of the catch 4A. By the catch 4A and the counterpart 8A, the braking module 6A is maintained in a position and moved relative to the rail 16A as required.

In the embodiment of FIG. 1, the braking modules 6A equipped with friction linings are lifted off from the rail 16A. Starting from the first operating position shown in FIG. 1, it should be noted that in the case of a failure of the power supply of the electromagnet 20A, it is provided that the catch 4A is released from the electromagnet 20A and thus also from the counterpart 8A into which the catch 4A engages and that it will move to a second operating position. This means at the same time that both braking modules 6A leave their positions shown in FIG. 1 and are pressed against the rail 16A by the spring 10A so that they cause a braking of the lift car which is not further illustrated here with respect to the rail 16A.

In this case, the release force 22A is no longer transferred because of a position change of the catch 4A, and the braking modules 6A will collapse because of a fail-safe function of the braking device 2A. Because of the use of the electromagnet 20A, this is also valid in the case of a failure of the supply voltage. An alternative for this case provides a functioning model of a catch mechanism for pulling release forces.

Figure 2:
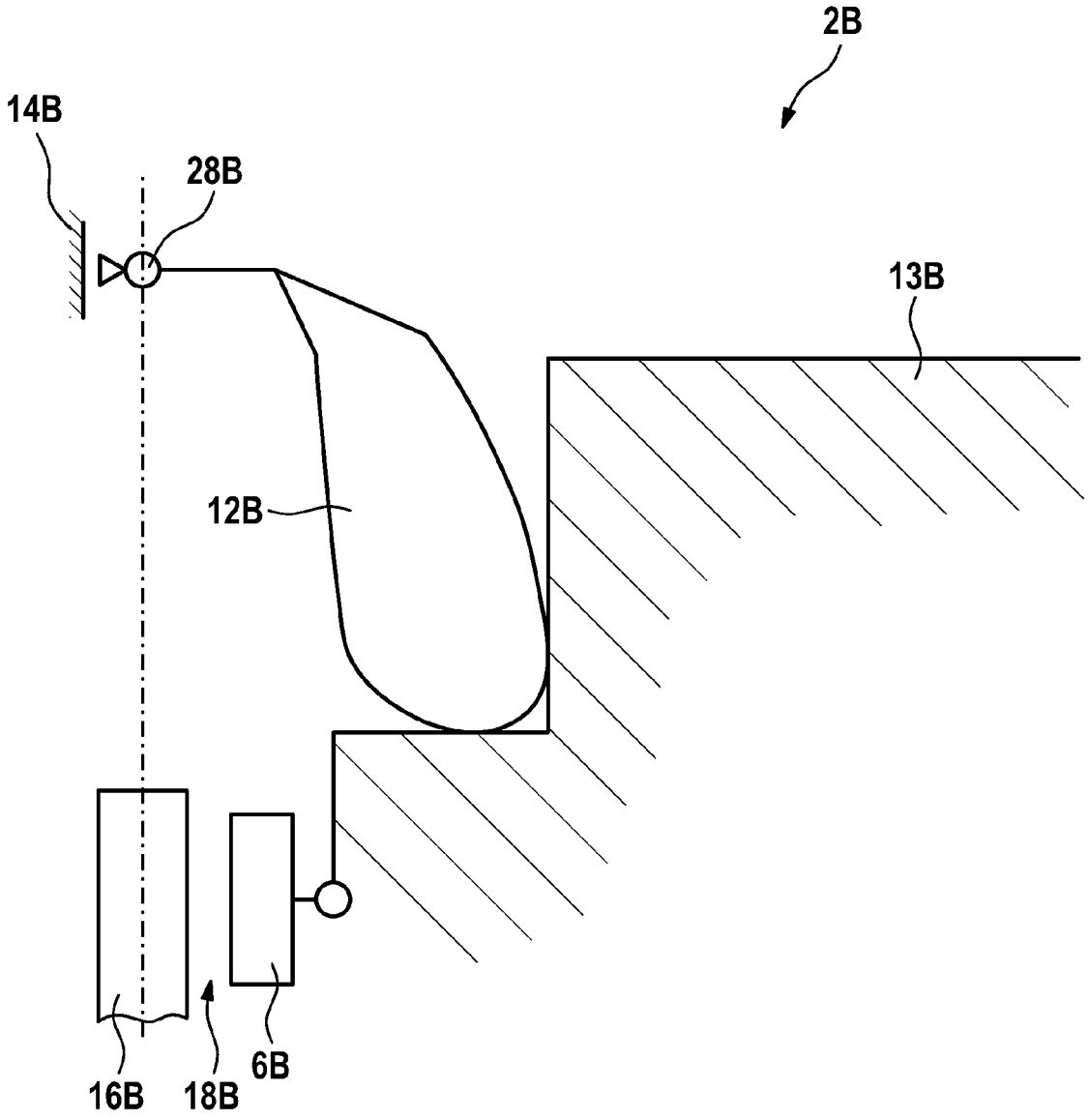
FIG. 2 shows a schematic view of a detail of a second embodiment of a braking device according to the invention.

A detail of a second embodiment of a braking device 2B is schematically illustrated in FIG. 2. Here, of the braking device 2B, a braking module 6B and a lever 12B which is hinged at a wall structure 14B by a fulcrum 28B are illustrated. The lever 12B cooperates with a power storage 13B so that the braking module 6B remains in the position shown here. Furthermore, the braking module 6B is spaced from a rail 16B with formation of a release gap 18B. In this second embodiment, the lever 12B has no fixed fulcrum.

Figure 3A:
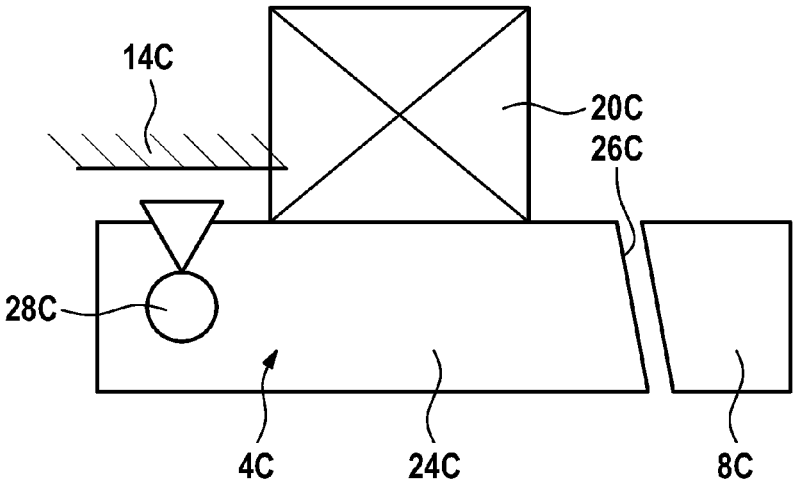
FIGS. 3A-3B show a schematic view of two examples of catches of a third embodiment of a braking device according to the invention.

FIG. 3A shows a schematic view of a first example of a catch 4C having an arm 24C with a slanted end 26C. This first example of the catch 4C is designed to cooperate with a counterpart 8C which is connected to at least one braking module not shown here.

Figure 3B:
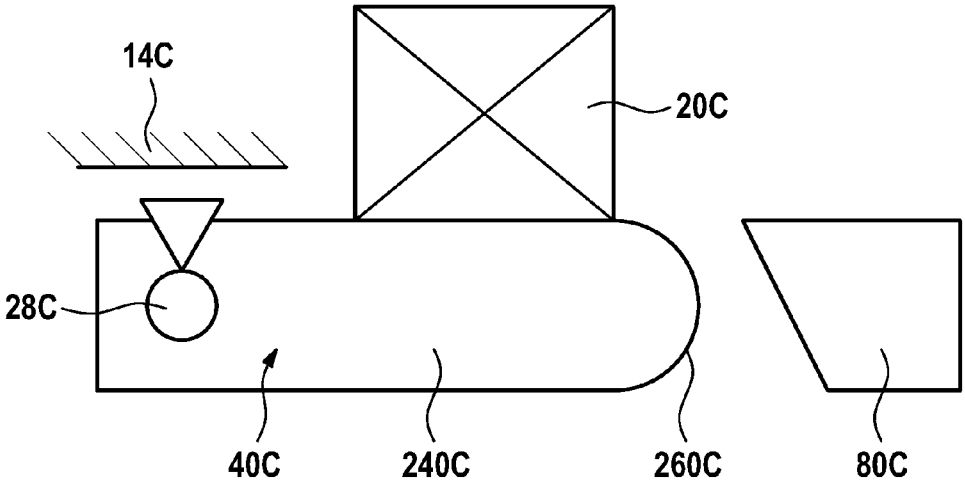

A second example of a catch 40C, shown in FIG. 3B, includes an arm 240C having a rounded end 260C (cf. the lower portion of FIG. 3). This second example of the catch 40C is designed to cooperate with a counterpart 80C which is connected to at least one braking module not shown in FIG. 3. Furthermore, FIG. 3 shows electromagnets 20C which are powered and thus attract the catches 4C, 40C so that for both catches 4C, 40C the first operating position is realized.

As shown in FIG. 3, the catches 4C, 40C and in particular the arms 24C, 240C of the catches 4C, 40C can have different forms and combinations of geometries which are also not shown here.

In the case of both examples, the catches 4C, 40C are rotatably supported by fulcrums 28C with respect to a wall structure 14C. A release force by which a release gap between the braking modules and a rail not shown in FIG. 3 is maintained is transferred by the catches 4C, 40C. The two electromagnets 20C hold the catches 4C, 40C in their respective position.

Figure 4:
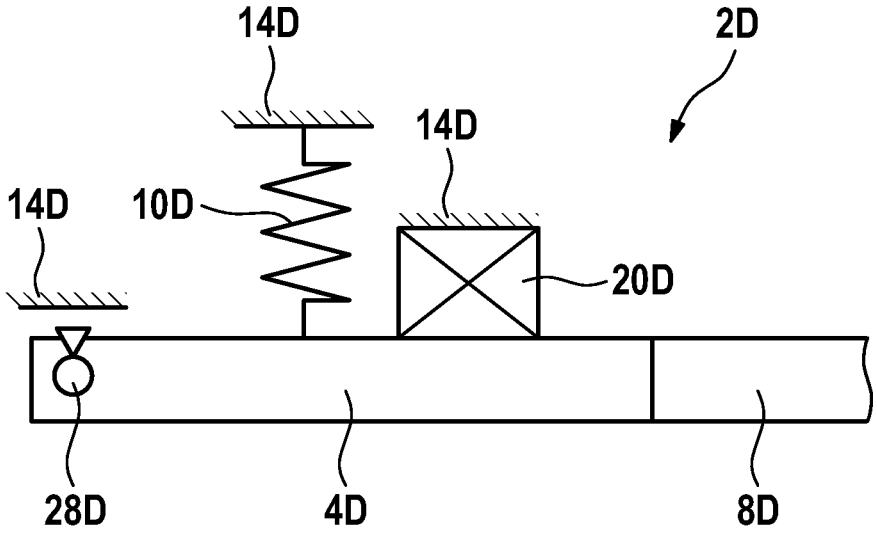
FIG. 4 shows a schematic view of a fourth embodiment of a braking device according to the invention.

FIG. 4 shows a schematic view of a fourth embodiment of a braking device 2D having a catch 4D which is rotatable relative to a wall structure 14D by a fulcrum 28D. Furthermore, FIG. 4 shows an electromagnet 20D which is also fixed at the wall structure 14D. The fourth embodiment of the braking device 2D according to the invention shown in FIG. 4 also has at least one counterpart 8D which is connected to at least one other braking module not shown here. Moreover, the catch 4D is connected to the wall structure 14D by a spring or another energy storage 10D.

In the operating position shown in FIG. 4, the catch 4D is pulled upwards by the electromagnet 20D so that the catch 4D is connected to the counterpart 8D and thus the at least one braking module connected to the counterpart 8D is released with a device which is stationary in this case with the formation of a release gap. As soon as the electromagnet 20D is disconnected from a power source and in the case of a power outage, respectively, the catch 4D snaps downwards so that the connection of the catch 4D with the counterpart 8D is interrupted and a braking operation for the at least one braking module is initiated by the at least one braking module contacting the stationary device with the generation of friction.

By the provision of the spring 10D, a jamming of the catch 4D is prevented because the release force acts upon the catch 4D from the right and the left side. The gravitational force of the catch 4D is counteracted by a friction force. In order to guarantee an actuation of the braking device 2D, it is provided in this context that the spring 10D is compressed between the catch 4D and the wall structure 14D so that the elastic force of the spring 10D acts downwards. As soon as no current is flowing in the electromagnet 20D, the catch 4D is released and falls downwards while engaged by the spring 10D.

Figure 5:
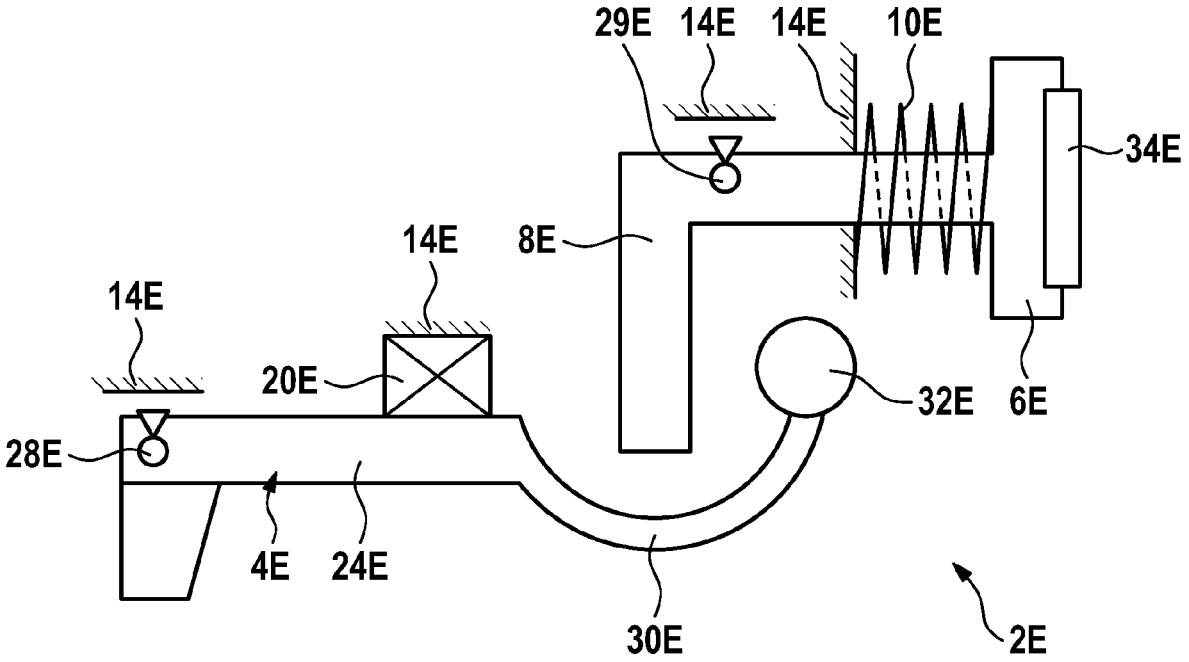
FIG. 5 shows a schematic view of a fifth embodiment of a braking device according to the invention.

FIG. 5 shows a schematic view of a fifth embodiment of a braking device 2E having a catch mechanism which is designed for tensile forces.

This fifth embodiment of the braking device 2E includes a catch 4E having an arm 24E at the end of which an arc 30E is disposed which has a sphere 32E at one end. The arm 24E of the catch 4E is displacibly and rotatably mounted relative to a wall structure 14E by a fulcrum 28E. At the wall structure 14E also an electromagnet 20E is mounted through which a current is flowing in the operating position shown in FIG. 5 so that it pulls the catch 4E upwards. By another fulcrum 29E, a counterpart 8E of a braking module 6E which in this case has a brake pad 34E is rotatably mounted relative to the wall structure 14E. A spring 10E is compressed between the wall structure 14E and the braking module 6E. The spring 10E is prevented from pressing the braking module 6E to the right by the fact that the catch 4E is connected to the counterpart 8E of the braking module and consequently provides a release force counteracting the spring 10E.

In the embodiment of FIG. 5 the same operating principle as in the preceding embodiments is provided. The only difference is that tensile forces can now be applied by the spring 10E upon the braking module 6E for releasing the braking module. A catch mechanism for acting upon the catch 4E and thus indirectly also for acting upon the braking module 6E in principle works in the same way as in the preceding examples.

Figure 6A:
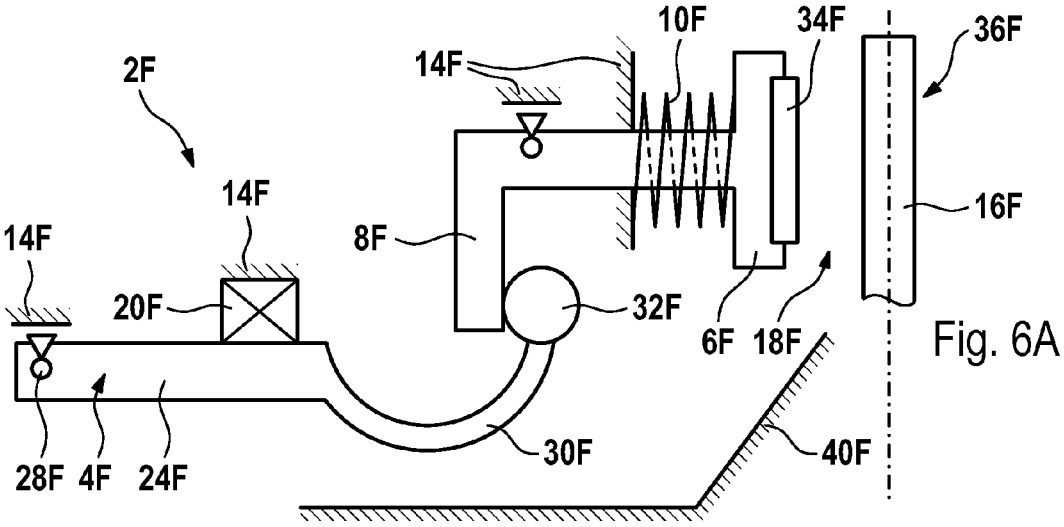
FIGS. 6A-6C show schematic views of a sixth embodiment of a braking device according to the invention in three different operating positions.
Figure 6B:
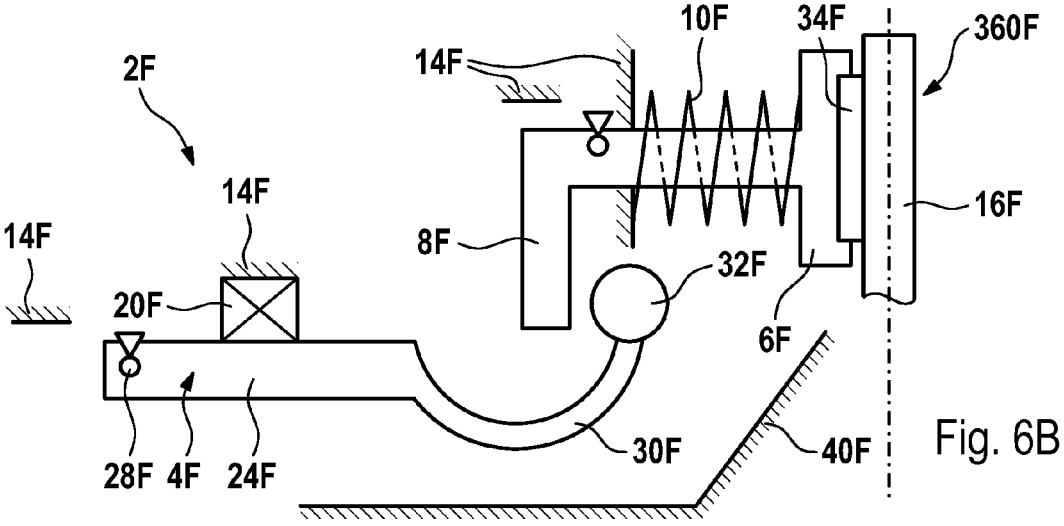
Figure 6C:
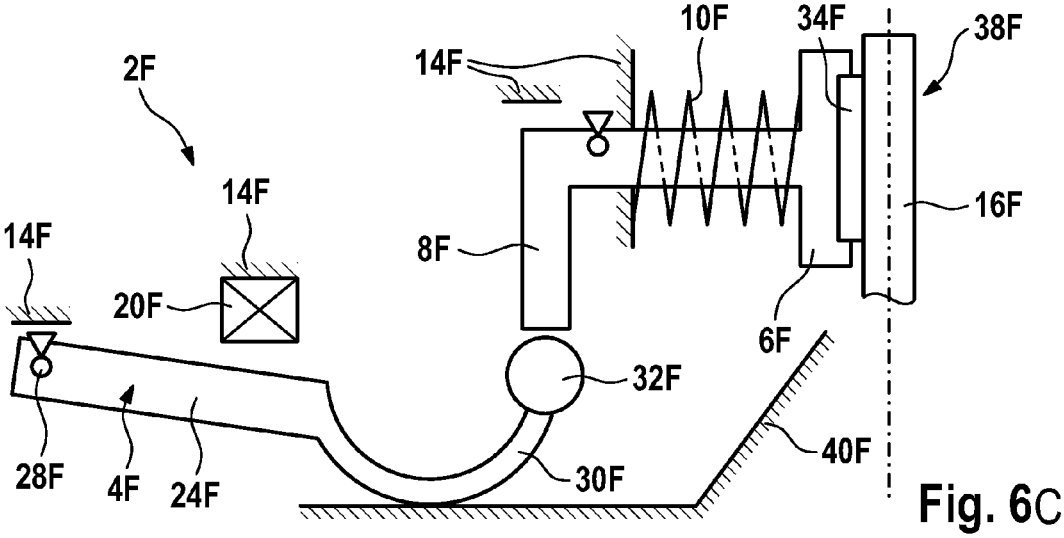

FIGS. 6A-6C show a sixth embodiment of a braking device 2F in three different operating positions, i.e. a first variant of a first operating position 36F in FIG. 6A, a second variant of a first operating position 360F shown in FIG. 6B, and an embodiment of a second operating position 38F shown in FIG. 6C.

FIGS 6A-6C show a sixth embodiment of a braking device in three operating positions 36F, 360F, 38F of a catch 4F and resulting operating positions of a braking module 6F. In detail, the braking device 2F comprises a catch 4F having an arm 24F, an arc 30F and a sphere 32F, wall structures 14F and furthermore the braking module 6F having a counterpart 8F and a brake pad 34F. In this context, a spring 10F is tensioned between the braking module 6F and one of the wall structures 14F. Moreover, FIGS. 6A-6C show a stationary device designed as a rail 16F and electromagnets 20F. FIG. 6 also shows a catching aid 40F configured as a path having an inclined plane.

In the first variant of the first operating position 36F, the catch 4F and thus the braking module 6F are in a first operating situation so that there is a release gap 18F between the brake pad 34F and the rail 16F. This is achieved by powering the electromagnet 20F so that it pulls the catch 4F upwards. Moreover, the arc 30F of the catch 4F encompasses the counterpart 8F of the braking module 6F, wherein the sphere 32F of the catch 4F abuts the counterpart 8F of the braking module 6F and thus pulls the braking module 6F to the left against a force of the spring 10F by the provision of a release force.

In a second variant of the first operating position 360F, which is shown in FIG. 6B, it is shown that the catch 4F is moved to the right by activating a not illustrated drive of a catch mechanism with an accompanying change of a release force which is transferred from the catch 4F to the braking module 6F, whereby the sphere 32F and thus also the catch 4F is released from the counterpart 8F of the braking module 6F which enables a movement of the braking module 6F to the right driven by the action of the spring 10F. This leads to the situation that the brake pad 34F of the braking module 6F abuts the rail 16F so that it brakes a relative motion of a lift car of a lift facility according to the sixth embodiment of the braking device 2F shown here with respect to the rail 16F.

The second operating position 38F is shown in FIG. 6C. Herein, it is provided that the power supply of the electromagnet 14F is interrupted, e.g. in an emergency so that this electromagnet 14F can no longer hold the catch 4F in the position shown in FIG. 6A and FIG. 6B, respectively, for the realization of the first operating positions 36F, 360F.

This leads to the catch 4F falling downwards via a fulcrum 28F under the influence of gravity. Thus, a connection between the catch 4F and the counterpart 8F of the braking module 6F is released and the braking module 6F is suddenly pushed in the direction of the rail 16F by the spring 10F expanding between the braking module 6F in the wall structure 14F so that an emergency stop is caused by the interaction between the brake pad 34F and the rail 16F so that a movement of the lift car which is equipped with the sixth embodiment of the braking device 6F shown here is disabled.

Thus, FIGS. 6A-6C show the braking device 2F and in particular the braking module 6F in the context of the first variant of the first operating position 36F in a completely released state. In order to obtain the second variant of the first operating position 360F, it is provided here that an advance of the braking module 6F by a movement of the catch 4F in the direction of the rail 4F is caused by a change of the release force.

In the lower portion the braking module 6F is closed by a downward rotation of the catch 4F for providing the second operating position 38F.

A reset of the catch 4F from the second operating position 38F into the first variant of the first operating position 36F and thus into the original position is carried out via a fixation by the electromagnet 20F by repowering the electromagnet 20F and manually lifting the catch 4F upwards.

The braking device 2F can be equipped with an autonomous return mechanism by an optional enhancement.

With such return mechanisms, the sagging catch 4F is brought back to the horizontal position by the catching aid 40F as a counterpart as in the first variant of the first operating position 36F when it is pulled back by a spring or a motor, e.g. a release motor of a catch mechanism configured for regulating the release force after it has travelled a certain distance. In this case, it is provided that the catch 4F is pushed along a path of the catching aid 40F, wherein the sphere 32F and the arc 30F of the catch 4F move underneath the counterpart 8F. If the electromagnet 20F should still not be powered, the catch 4F will fold downwards again trying to release the braking module 6F. If the electromagnet 20F should hold the catch 4F in balance again, however, the braking module 6F will be released by the pulling of the motor.

Figure 7:
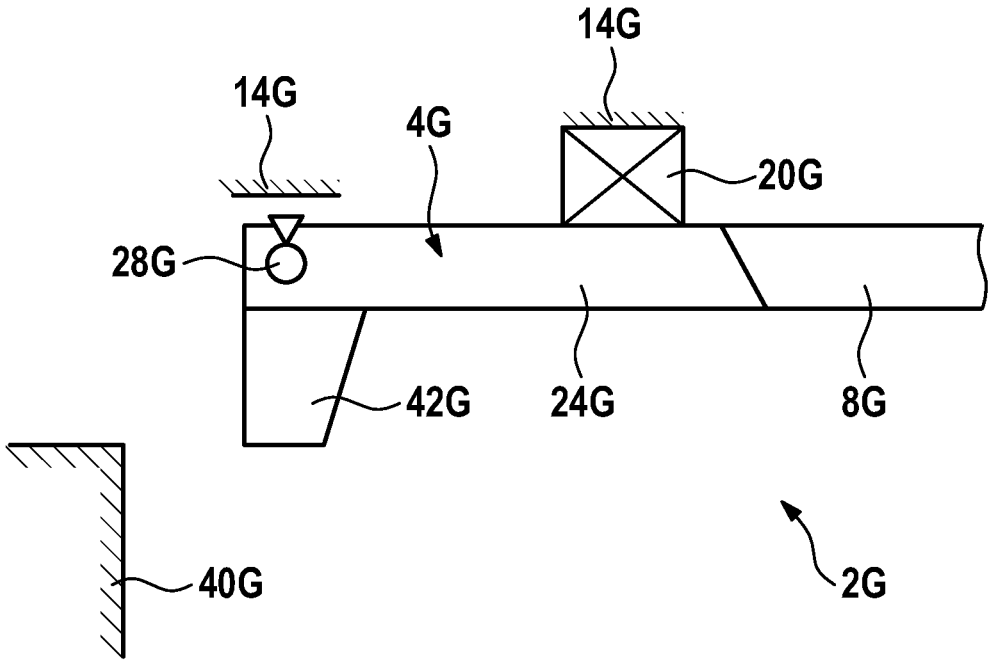
FIG. 7 shows a schematic view of a seventh embodiment of a braking device according to the invention.

The seventh embodiment of a braking device 2G illustrated in a schematic view in FIG. 7 includes a catch 4G, a counterpart 8G of a braking module which is not further illustrated here, an electromagnet 20G, a fulcrum of the catch 28G, wall structures 14G and a catching aid 40G configured as a path.

In FIG. 7, it is provided that the catch 4G is connected to the counterpart 8G so that the braking device 2G and in particular the braking module is in a released state and thus is in the first operating position. After releasing the braking device 2G and thus also the braking module by interrupting an electric connection to the electromagnet 20G, the catch 4G rotates downwards around the fulcrum 28G and is thereby separated from the counterpart 8G and thus also from the braking module.

For transferring the catch 4G from the released operating position back to the first operating position shown in FIG. 7, the catching aid 40G is provided here by which a return mechanism for the catch 4G is to be realized using pressure forces, wherein the catching aid 40G cooperates with an extension 42G mounted at an arm 24G of the catch 4G thus regulating a motion sequence provided for locking the catch 4G.

Figure 8:
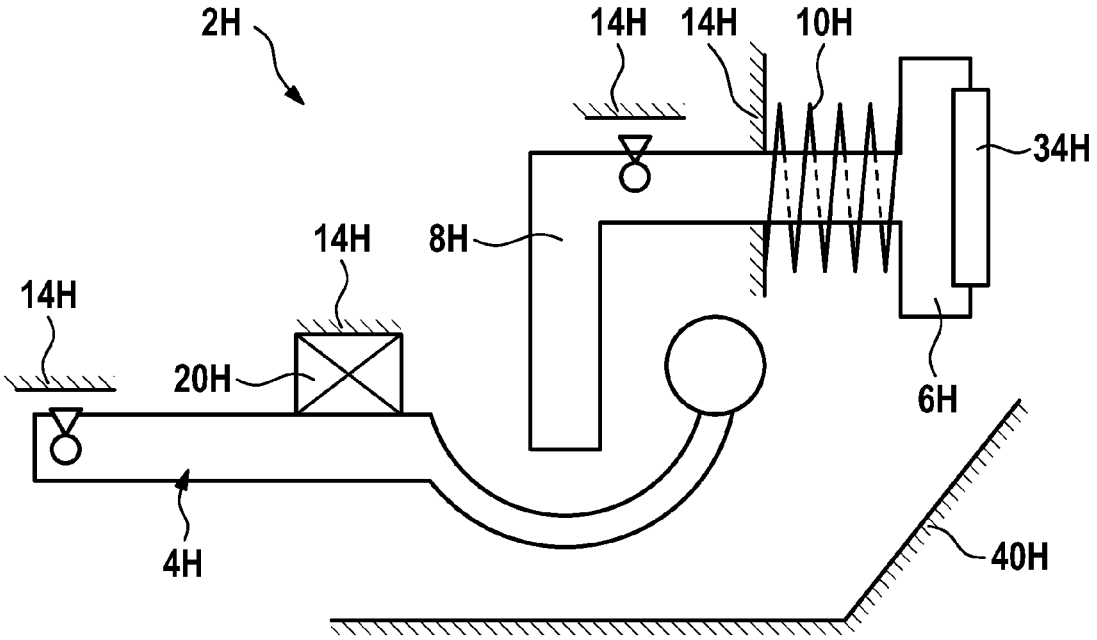
FIG. 8 shows a schematic view of an eighth embodiment of a braking device according to the invention.

An eighth embodiment of a braking device 8H is schematically illustrated in FIG. 8. This eighth embodiment of the braking device 8H also includes a catch 4H, a braking module 6H having a counterpart 8H, and a spring 10H which is fixed between a wall structure 14H and the braking module 6H while providing a tensile force. Moreover, FIG. 8 shows an electromagnet 20H, a brake pad 34H and a catching aid 40H.

For the braking device 2H having a tensile force transfer via the catch 4H, the return mechanism is shown in the embodiment in FIG. 8. In this case, the catch 4H, when actuated, drops to the catching aid 40H configured as a support or a path along which the catch 4H is displaced in a forward movement by a spring or a motor of a catch mechanism. The catching aid 40H along which the catch 4H consequently moves guides it around the counterpart 8H and thus to reestablish contact between the catch 4H and the electromagnet 20H. If the latter is not powered, no release of the braking module 6H can be initiated by a motor movement because the catch 4H does not engage the counterpart 8H because of the shape of the catching aid 40H on which it runs. If the electromagnet 20H is powered, the catch 4H can be lifted off from the catching aid 40H so that a release of the braking module 6H is possible. A connection of the braking device 2H for braking can be achieved via dampers at a lift car not illustrated here.

The electromagnet 20H can be fixedly supported. It is also possible that the electromagnet 20H is moved synchronously with the catch 4H in order to avoid friction between the electromagnet 20H and the catch 4H if it is moved relative to the counterpart 8H with an accompanying change of the release force. The electromagnet 20H can additionally be moveably supported by a spring and a corresponding support in order to obtain a gapless contact between the catch 4H and the electromagnet 20H.

Figure 9:
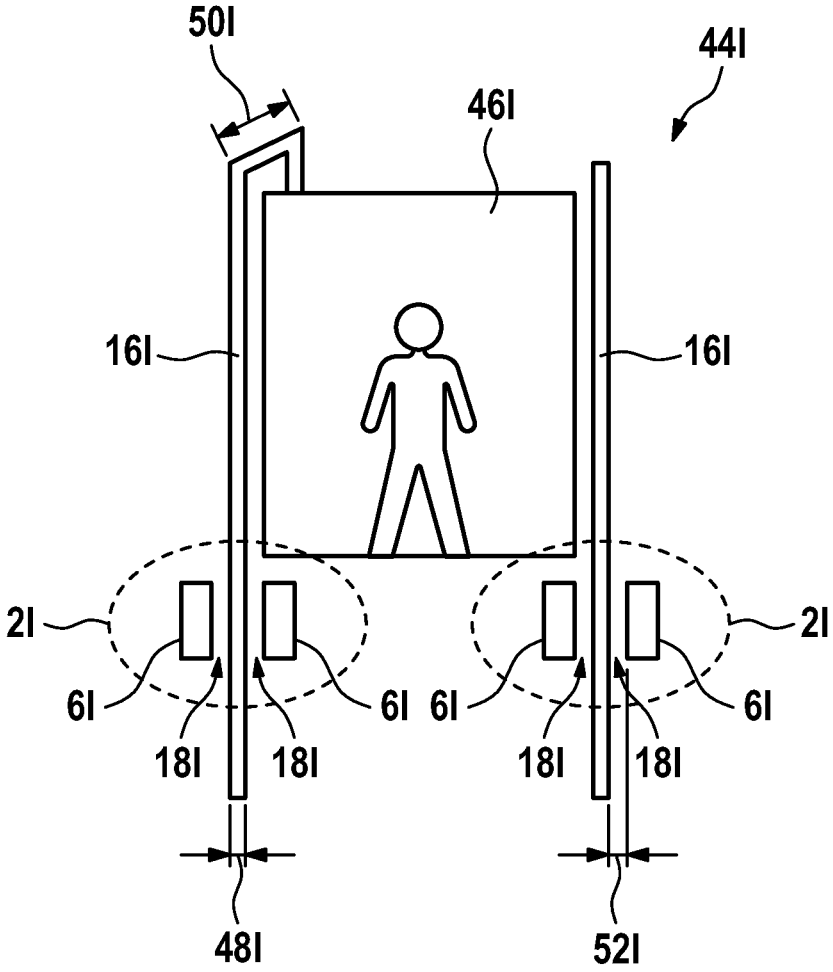
FIG. 9 shows a schematic view of an example of a lift facility having two ninth embodiments of a braking device according to the invention.

FIG. 9 is a schematic view of an embodiment of a lift facility 44I having two rails 16I as a stationary installation of the lift facility 44I, a lift car 46I and two configurations of a ninth embodiment of a braking device 2I for braking the lift car 46I which have two braking modules 6I each. Here, it is provided that the thickness 48I of one of the rails 16I is 16 mm and that the depth 50I of one of the rails 16I is approximately 50 mm.

The braking devices 2I shown in FIG. 9 are in a released state in the embodiment illustrated in FIG. 9, wherein the braking modules 6I are in the first operating position, wherein a release gap 18I having a width 52I of 4 mm is respectively provided between a braking module 6I and a rail 16I which is achieved here by connecting catches not shown here to the braking modules 6I.

In order to brake a movement of the lift car 46I relative to the rails 16I, the release force transferred from a catch to a braking module 6I is changed by changing the width 52I of a respective release gap 18I. In order to intercept a fall of the lift car 46I, it is provided that the braking modules 6I are released from the catches and reach a second operating position so that the braking modules 18I contact the rails 16I thereby generating friction.

Figure 10:
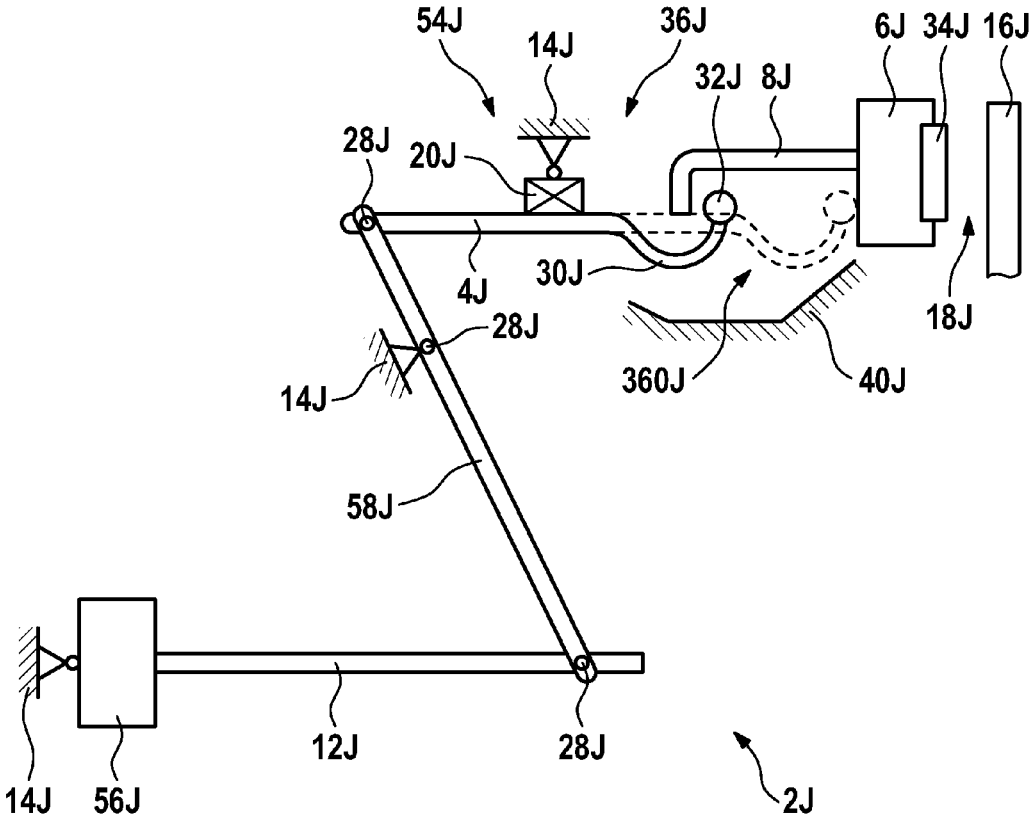
FIG. 10 shows a schematic view of a tenth embodiment of a braking device according to the invention.

FIG. 10 shows a schematic view of a tenth embodiment of a braking device 2J which in the same way as the other embodiments already disclosed comprises a catch 4J, an electromagnet 20J, a braking module 6J having a brake pad 34J, a counterpart 8J, an electromagnet 20J supported at a wall structure 14J and a catching aid 40J.

This embodiment of the braking device 2J is provided as a component of a vehicle configured as a lift car. In FIG. 10, the catch 4J and the braking module 6J are in a first variant of a first operating position 36J with a release gap 18J existing between the brake pad 34J of the braking module 6J and a rail 16J to which the lift car can move. For suggesting a second variant of a first operating situation 360J, an arc 30J and a sphere 32J of the catch 4J are shown in dashed lines in a second position of the first operating position 360J which is displaced to the left, whereby in case of a change of the release force it is achieved that the catch 4J and thus the braking module 6J move towards the rail 16J and thus cause a braking of the lift car.

Moreover, FIG. 10 shows a catch mechanism 54J configured as a release unit comprising a linear motor 56J which is supported at a wall structure 14J, and a lever 12J and a lever arm 58J. In this case, the lever 12J is connected to the linear motor at a first end and to the lever arm 58J via a fulcrum 28J at a second end. The lever arm 58J is supported at a wall structure 14J via a second fulcrum and rotatably connected to the catch 4J via a third fulcrum 28J.

This embodiment of the braking device 2J including the release unit and the catch mechanism 34J, respectively, is schematically illustrated in FIG. 10. A translational motion of the linear motor 56J is transferred by a lever transmission provided by the lever 12J, the lever arm 58J and the catch 4J for varying the release force and further a position of the braking module 6J through the catch 4J to the braking module 6J.

The catch 4J is interposed before the braking module 6J, the catch 4J being held in a horizontally oriented first operating position 36J by the electromagnet 20J. Hereby, the catch 4J engages the counterpart 8J which is connected to the braking module 6J and can translate the braking module in case of a movement of the linear motor 56J so that the release force is regulated hereby.

For not having to treat the linear motor 56J as a security component, a disengagement of the linear motor 56J can be carried out by the electromagnet 20J. To this end, the electromagnet 20J is switched so that no current flows through it, and a catch 4J consequently falls to the plane of the catching aid 40J so that the linear motor 56J no longer engages the braking module 6J. By this arrangement the braking module 6J can be opened and closed driven by a motor. Even large release gaps 18J can be realized by corresponding settings of the release force and the geometry of the lever 58J. However, an engagement of the braking module 6J is also possible by the catch 4J.

When the catch 4J is actuated and takes a second operating position, for the time being no releasing is possible anymore. For reengaging the catch 4J, the linear motor 56J advances. Hereby, the catch 4J is pushed in its front part upon the inclined plane of the catching aid 40J and is thereby lifted until it contacts the electromagnet 20J again. If still no current flows through the electromagnet 20J, it is not possible that the catch 4J engages the counterpart 8J. If the power to the electromagnet 20J is restored, however, it will hold the catch 4J in a horizontal position again. Now, the linear motor 56J enables a release again.

Figure 11:
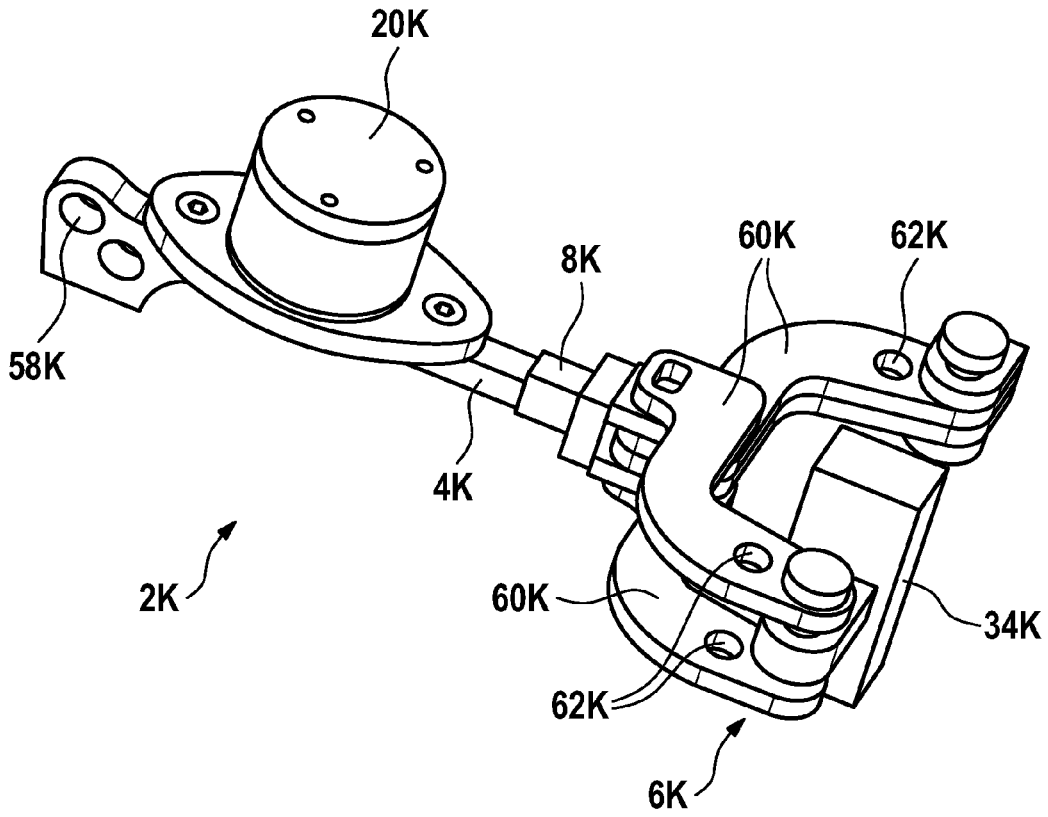
FIG. 11 shows a schematic view of an eleventh embodiment of a braking device according to the invention.

FIG. 11 shows a release mechanism of a schematically illustrated embodiment of a braking device 2K having a catch 4K and a braking module 6K which comprises a brake pad 34K, a counterpart 8K, brake levers 60K and fixed points 62K. The schematic view of FIG. 11 further shows an electromagnet 20K which attracts the catch 4K in a powered state, and a portion of a lever arm 58K by which a force of a motor not further illustrated here can be transferred to the catch 4K.

With this release mechanism, a release force, here a compression force of the motor, is used for releasing the braking module 6K. The motor or the linear motor is connected to the catch 4K at the upper bore 58K. In a first operating position, the motor presses the catch 4K onto the counterpart 8K and then onto the levers 60K of the braking module 6K. The levers 60K are fixedly supported at their fixed points 62K. This leads to a rotation around these fixed points 62K. A compression by the motor therefore has the consequence of moving the brake shoes 34K apart. Thus, the motor for releasing bridges or compensates the compression force exerted by a not illustrated spring which acts in the region of a rail upon the brake shoes 34K. The catch 4K itself presses the counterpart 8K.

The abutting surfaces of the catches 4K and of the counterpart 8K are inclined by a few degrees with respect to an axis of the catch 4K. In the released state, this leads to a downwardly directed actuation force at the catch 4K. This is compensated by the electromagnet 20K disposed on the catch 4K. An actuation of the catch 4K is thus possible by switching off the voltage at the electromagnet 20K. The compression force by the release operation and the gravitational force of the catch 4K itself cause it to fall down if the electromagnet 20K is not powered. By the fail-safe function of the braking device 2K, the brake pads 34 of the braking module 6K are always pressed on by the spring in case of a power supply outage.

Figure 12:
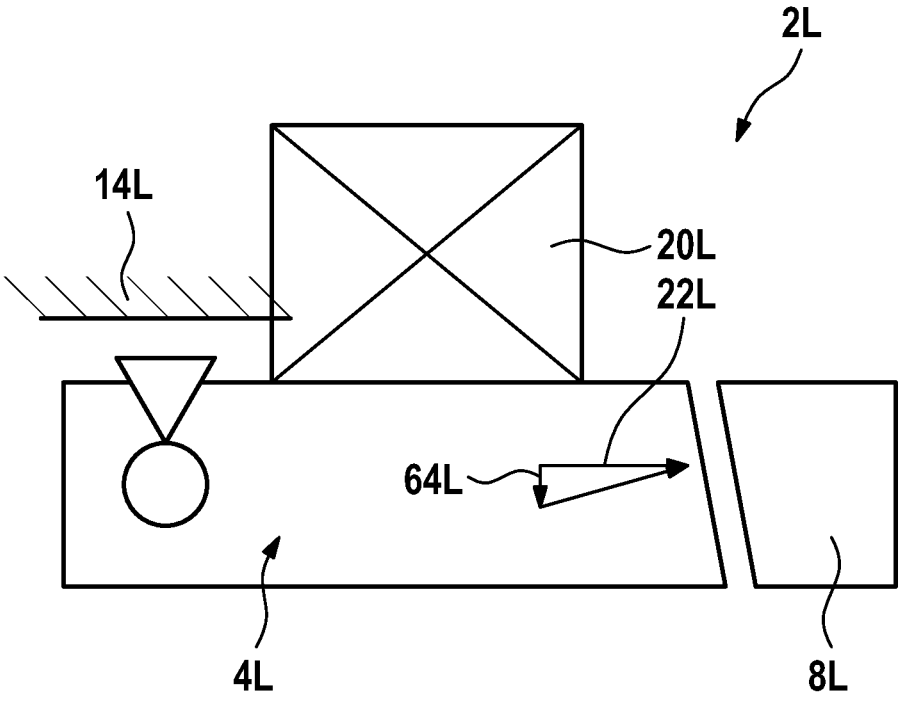
FIG. 12 shows a schematic view of a detail of a twelfth embodiment of a braking device according to the invention.

FIG. 12 shows a schematic view of an example of a twelfth braking device 2L comprising a catch 4L which is supported at a wall structure 14L, an electromagnet 20L and a counterpart 8L of a braking module not further illustrated here.

If the braking device 2L shown in FIG. 12 is in the first operating position, it is provided that a current is supplied to the electromagnet 20L so that it pulls the catch 4L upwards. Moreover, a variable release force 22L is applied as a consequence of driving a mechanism of the catch 4L not shown here, whereby a connection between the catch 4L and the counterpart 8L of the braking module is provided. The release force 22L causes an actuation force 64L at the contact surface between the catch 4L and the counterpart 8C which is not perpendicular to the line of actuation of the release force 22L. This actuation force 64L is caused if the electromagnet 20L is powered. If the power supply for the electromagnet 20L is interrupted, the catch 4L is released from the electromagnet 20L because of its mass and falls downward, whereby a connection from the catch 4L to the counterpart 8L and thus also to the braking module is interrupted. The force of gravity of the catch 4L additionally contributes, typically to a small extent, to the actuation force 64L. This leads to the catch 4L and the braking module assuming a second operating position by which a release gap between a rail not shown here and the braking module present during the first operating position is eliminated which causes a braking or cushioning of a lift car having the twelfth embodiment of the braking device 2L illustrated here.

Figure 13:
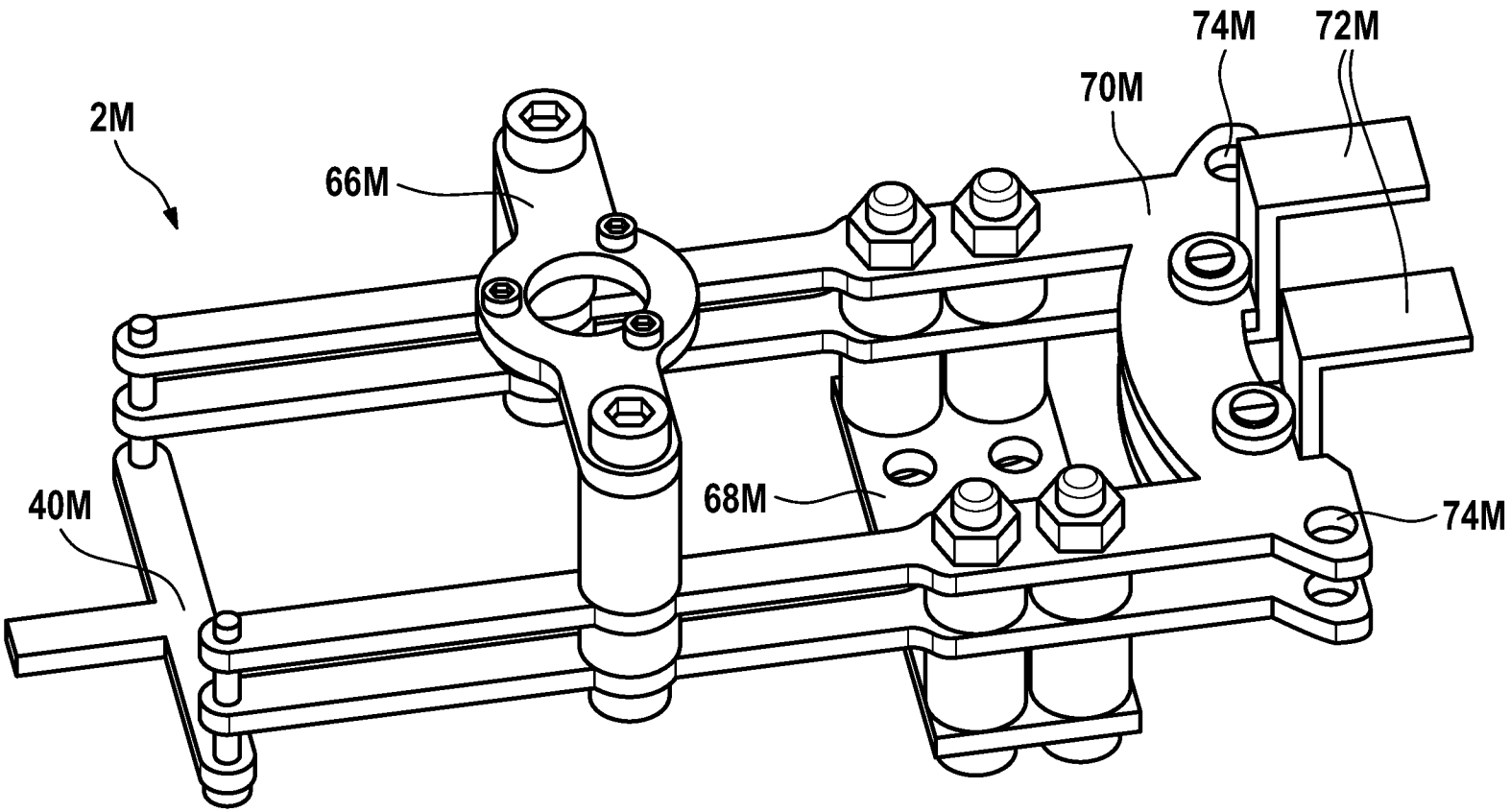
FIG. 13 shows a schematic view of a detail of a thirteenth embodiment of a braking device according to the invention.

A holding device of a thirteenth embodiment of a braking device 2M is schematically illustrated in FIG. 13. This holding device comprises a catching aid 40M, a magnet holder 66M, a connection plate 68M, a spacer 70M and two Z-profiles 72M. This holding device of FIG. 13 is provided as a frame for a release mechanism comprising the electromagnet and a not illustrated catch and a not illustrated counterpart of a braking module which have been described in the preceding Figures, however.

In the right portion, the two Z-profiles 72M absorb the braking force of the brake shoes positioned below them. The Z-profiles 72M are screwed to the two spacers 70M. Those absorb the braking forces and transfer them downwards to the connection plate 68M which is horizontally displaceable according to the case of application.

Thus, the spacer 70M also absorbs the braking forces and transfers them if the braking module is closed. Bolts engage bores 74M of the spacer 70M, and they provide the fixed points for the lever action of the release mechanism. Thus, also in the released state, the spacer 70M absorbs the spring force in the region of a guide rail. In the middle portion of FIG. 13, the holder 66M for the electromagnet holding the catch in equilibrium is shown at the spacer 70M. The left portion shows the catching aid 40M which autonomously returns the catch into the original position and thus a first operating position by a movement of a motor of a catch mechanism.

In the entire braking device 2M, all bolt connections are designed so that they do not transfer inflections independently of the load case, i.e. braking or releasing. The bolts which fulfill a hinge function here are only subject to shear actions so that an asymmetric arrangement of levers and brake shoes is realized.

We claim:

1. A lift facility in a lift shaft, comprising:

at least one lift car including at least one braking device;

the at least one braking device comprising at least one braking module to cooperate with a device that moves relative to the at least one braking module, and the at least one braking device having a catch which is movable between a first variant and a second variant of a first operating position and a second operating position;

the catch, in the first variant of the first operating position, is connected to the at least one braking module so that the catch holds the at least one braking module away from the device at a release gap;

the catch, in the second variant of the first operating position, is released from the at least one braking module with a release force so that the at least one braking module is in contact with the device;

the catch, in the second operating position, is separated from the at least one braking module when electrical power is interrupted so that the at least one braking module is in contact with the device;

at least one force module or energy storage to provide a braking force to the at least one braking module when the catch is at the second variant of the first operating position or at the second operating position;

a holding device for holding the catch, when electrical power is on, at the first variant or the second variant of the first operating position, and for releasing the catch from the first variant or the second variant of the first operating position to the second operating position, when electrical power is interrupted, so that the at least one braking module performs braking operation by a biasing force received from the at least one force module or energy storage;

at least one catching aid to transfer the catch from the second operating position to the first variant or the second variant of the first operating position; and the at least one braking device is configured to brake movement of the at least one lift car.

2. The lift facility according to claim 1, wherein the at least one braking module cooperates with a stationary device.

3. The lift facility according to claim 1, wherein the at least one braking module cooperates with a rail of the lift facility.

4. The lift facility according to claim 1, wherein:

the at least one braking device is stationarily disposed relative to the lift shaft; and the at least one braking module is designed to cooperate with the device while the device is moving.

5. The lift facility according to claim 1, and further comprising at least one drive for providing the release force.

6. A lift facility in a lift shaft as in claim 5, wherein the at least one drive includes a linear drive.

7. A lift facility in a lift shaft as in claim 5, wherein the at least one drive is configured to regulate the release force.

8. The lift facility according to claim 1, wherein:

the holding device includes an electromagnet; and the electromagnet holds the catch in a powered state in the first variant or the second variant of the first operating position.

9. The lift facility according to claim 1, and further comprising at least one lever to adjust a distance between the at least one braking module and the device.

10. The lift facility according to claim 1, wherein the at least one force module includes a spring.

11. The lift facility according to claim 1, wherein the release force releases the at least one braking module to make contact with the device with the braking force.

12. The lift facility according to claim 1, wherein the at least one braking module has a counterpart to cooperate with the catch.

13. A lift facility in a lift shaft, comprising:

at least one lift car including at least one braking device;

the at least one braking device comprising at least one braking module to cooperate with a device that moves relative to the at least one braking module, and the at least one braking device having a catch which is movable between two operating positions;

the catch, in a first variant of a first operating position, is connected to the at least one braking module wherein the catch holds the at least one braking module away from the device at a release gap;

the catch, in a second variant of the first operating position, is released from the at least one braking module by a release force that moves the catch toward the device;

the catch, in a second operating position, is separated from the at least one braking module in a downward rotation so that the at least one braking module is in contact with the device;

an electromagnet in a powered state for holding the catch in the first variant or second variant of the first operating position;

the electromagnet releases the catch into the second operating position when power to the electromagnet is interrupted thereby activating the at least one braking module into contact with the device; and the at least one braking device is configured to brake movement of the at least one lift car.

14. A lift facility in a lift shaft as in claim 13, wherein the catch falls downwardly by gravity via a fulcrum when power to the electromagnet is interrupted.

* * * * *